US005797065A

United States Patent [19]

Arai

[11] Patent Number: 5,797,065

[45] Date of Patent: Aug. 18, 1998

[54] ELECTROPHOTOGRAPHIC RECORDING APPARATUS

[75] Inventor: Seiji Arai, Tokyo, Japan

[73] Assignee: Kabushiki Kaisha Toshiba, Kawasaki, Japan

[21] Appl. No.: 939,907

[22] Filed: Sep. 29, 1997

Related U.S. Application Data

[63] Continuation of Ser. No. 643,096, May 2, 1996, abandoned, which is a continuation of Ser. No. 361,174, Dec. 21, 1994, abandoned, which is a continuation of Ser. No. 214,002, Mar. 15, 1994, abandoned, which is a continuation of Ser. No. 40,085, Mar. 30, 1993, abandoned, which is a continuation of Ser. No. 853,016, Mar. 18, 1992, abandoned, which is a continuation of Ser. No. 670,958, Mar. 18, 1991, abandoned.

[30] Foreign Application Priority Data

Mar. 19, 1990 [JP] Japan ..... 2-66960
Aug. 20, 1990 [JP] Japan ..... 2-217218

[51] Int. Cl.[6] ..... G03G 21/14

[52] U.S. Cl. ..... 399/46; 399/55

[58] Field of Search ..... 399/46, 270, 38, 399/55

[56] References Cited

U.S. PATENT DOCUMENTS 3,728,016 4/1973 Harbour et al. .
3,901,591 8/1975 Mitsumasu .
3,914,045 10/1975 Namiki et al. .
4,141,648 2/1979 Gaitten et al. .
4,233,386 11/1980 Aizawa et al. .
4,239,373 12/1980 Weikel .
4,432,631 2/1984 Bacon et al. .
4,564,282 1/1986 Shenoy .
4,746,957 5/1988 Nishiyama et al. ..... 399/200
5,030,999 7/1991 Lindblad et al. ..... 355/297

*Primary Examiner*—R. L. Moses
*Attorney, Agent, or Firm*—Finnegan, Henderson, Farabow, Garrett & Dunner, L.L.P.

[57] ABSTRACT

An electrophotographic recording apparatus including a photosensitive drum, a charging section, an exposure section, a developing section, and a transfer section. The charging section is used for recharging the photosensitive drum. In the electrophotographic recording apparatus, the photosensitive drum is recharged after a developed image is transferred to a transfer sheet. Thus, after the transfer section is stopped, the charging and developing sections remain active for at least a rotation of the photosensitive drum. Accordingly, the electric voltage level of the photosensitive drum is uniform.

1 Claim, 3 Drawing Sheets

ELECTROPHOTOGRAPHIC RECORDING APPARATUS

This application is a continuation of Ser. No. 08/643,096, filed May 2, 1996, which is a continuation of Ser. No. 08/361,174, filed Dec. 21, 1994, which is a continuation of Ser. No. 08/214,002, filed Mar. 15, 1994, which is a continuation of Ser. No. 08/040,085, filed Mar. 30, 1993, which is a continuation of Ser. No. 07/853,016, filed Mar. 18, 1992, which is a continuation of Ser. No. 07/670,958, filed Mar. 18, 1991, all now abandoned.

BACKGROUND OF THE INVENTION

1. Field of the Invention

The present invention relates to an electrophotographic recording apparatus which is capable of recording an image without use of an erasing means.

2. Description of the Related Art

Carson's process is typical of electrophotographic recording apparatus using toner. This process includes charging, exposure, development, transfer, cleaning and erasing steps performed sequentially with the respective components of the system being disposed around a photosensitive body. The charging, exposure, development, transfer, cleaning and erasing steps were all indispensable.

The erasing step is done by an erasing unit. The light is used for the erasing unit. The light is a light emitting diode, a xenon lamp or a fluorescent lamp. In electrophotographic recording apparatus which use Carson's process, the erasing means is required. Therefore, in electrophotographic recording apparatus of Carson's process, a light emitting diode, a xenon lamp or a fluorescent lamp is required as the erasing unit. The erasing step is required to remove any remaining electric charge from the drum. Charging the surface of the photosensitive means is the next step.

Usually, the light emitting diode, the xenon lamp, or the fluorescent lamp used as the erasing unit occupy a large area in an electrophotographic recording apparatus. Therefore, an electrophotographic recording apparatus is made large by the erasing unit.

For example, in an office, one must prepare a large area for an electrophotographic recording apparatus. This is an important problem for effective utility of space in the office.

SUMMARY OF THE INVENTION

Accordingly, it is the general object to solve the problem of occupation of a large area by an electrophotographic recording apparatus.

A more specific object of the invention is to reduce the volume of the case of the electrophotographic recording apparatus.

Another object of the invention is to remove the erasing unit from an electrophotographic recording apparatus.

Another object of the invention is to reduce the power consumption of the electrophotographic recording apparatus.

To attain the objects according to the invention there is provided an electrophotographic recording apparatus comprising a photosensitive means, a charging means, an exposure means, a developing means, a transfer means and a means for recharging the photosensitive means.

In the electrophotographic recording apparatus, the photosensitive means is recharged after a developed image is transferred to a transfer sheet.

The electric voltage level of the photosensitive means is uniform because after the transfer means is stopped, the charge means and develop means are active.

DESCRIPTION OF THE PREFERRED EMBODIMENTS

This invention will not be described in detail with reference to an embodiment thereof shown in the accompanying drawings.

Figure 1:
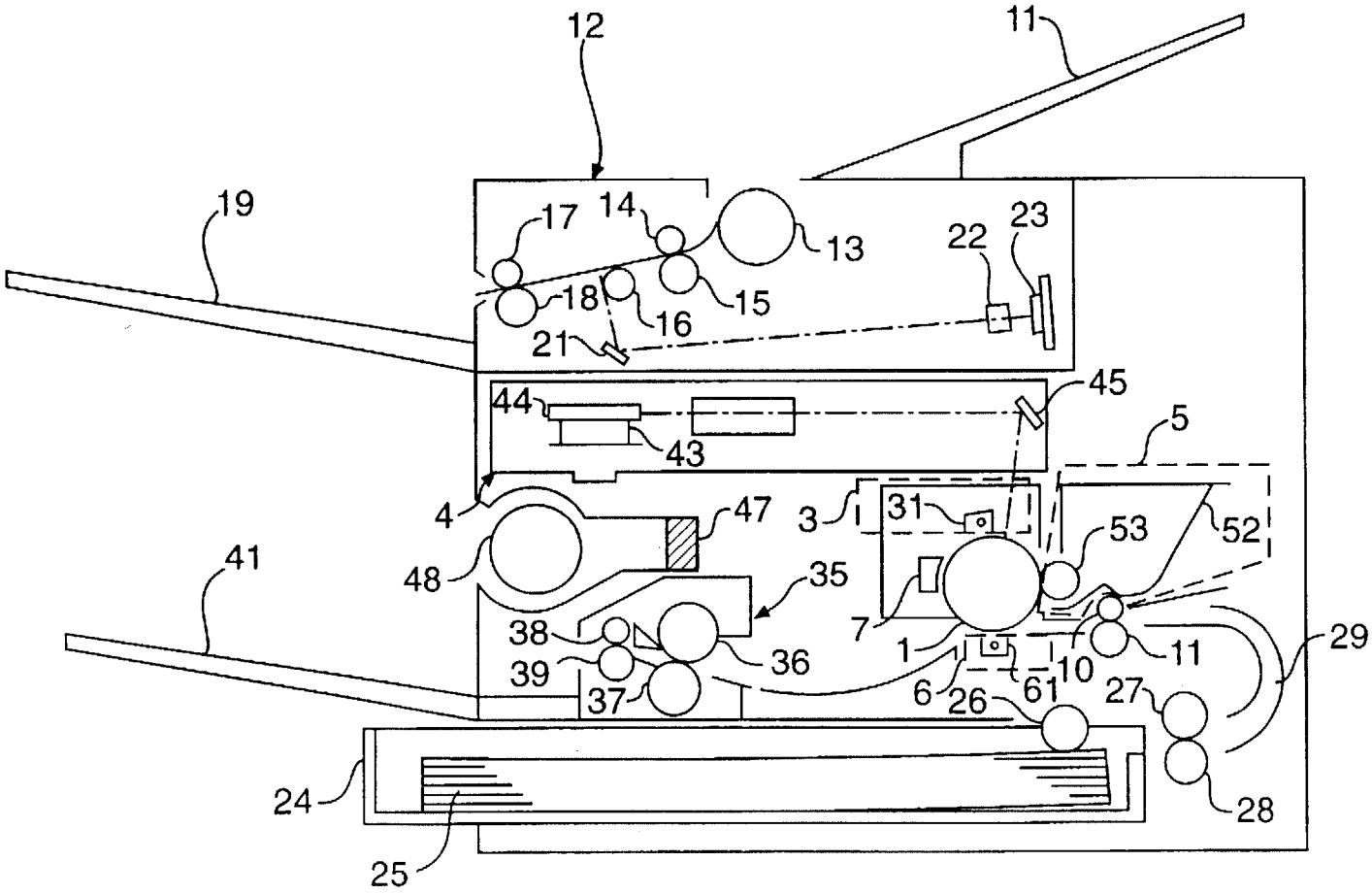
FIG. 1 is a cross-sectional view of an electrophotographic recording apparatus of the invention.

This electrophotographic recording apparatus is shown in FIG. 1. A reading system and a recording system in this apparatus will now be described.

In the reading system, a document placed on a paper feed table 11 is transferred through a scanner section 12 in the following order: a roller 13, between rollers 14 and 15, a roller 16 and between rollers 17 and 18. The document transferred through the above-described passage is discharged onto a document discharge tray 19. At that time, in the scanner section 12, the document being transferred in a sub-scanning direction is repeatedly read in a main scanning direction through a mirror 21 and a lens system 22 by means of a charge-coupled device image sensor (hereinafter referred to as "CCD image sensor") 23. This causes an image signal corresponding to an image of the document to be output from the CCD image sensor 23.

On the other hand, in the recording system, a piece of recording paper 25 housed in a cassette 24 is taken out by a pick up roller 26 and led to a U-turn guide 29 between an automatic paper feed roller 27 and a separating roller 28. The recording paper is then passed between rollers 10 and 11 and photosensitive drum 1. Further, the recording paper is transferred through a fixing section 35, between rollers for thermal fixation 36 and 37, between rollers 38 and 39, and then discharged onto a recording paper discharge tray 41.

At that time, in an exposure section 4, an optical signal corresponding to the image signal is reflected by a polygon mirror 44 of an equilateral prism being rotated by a motor 43 and further reflected by a mirror 45 and applied onto the photosensitive drum 1. This causes the optical signal to be repeatedly applied in the main scanning direction to the photosensitive drum 1 being rotated with the transfer of the recording paper in the sub-scanning direction.

The photosensitive drum 1 is electrified by a charger 31 and then exposed to the optical signal from the exposure section 4, thereby forming a latent image. The latent image on the photosensitive drum 1 is developed by guiding a toner housed in a toner box 52 in the developing section 5 to the photosensitive drum 1 with the rotation of the sleeve 53. A toner image formed by the development on the photosensitive drum 1 is transferred on the recording paper being conveyed along the photosensitive drum 1. Further, the recording paper is pressed and heated between the thermal fixing rollers 36 and 37 in the fixing section 35, so that transferred toner image is fixed.

Ozone generated within the electrophotographic recording apparatus is absorbed on an ozone absorption filter 47 and diffused by an ozone diffusing fan 48 for release.

Figure 2:
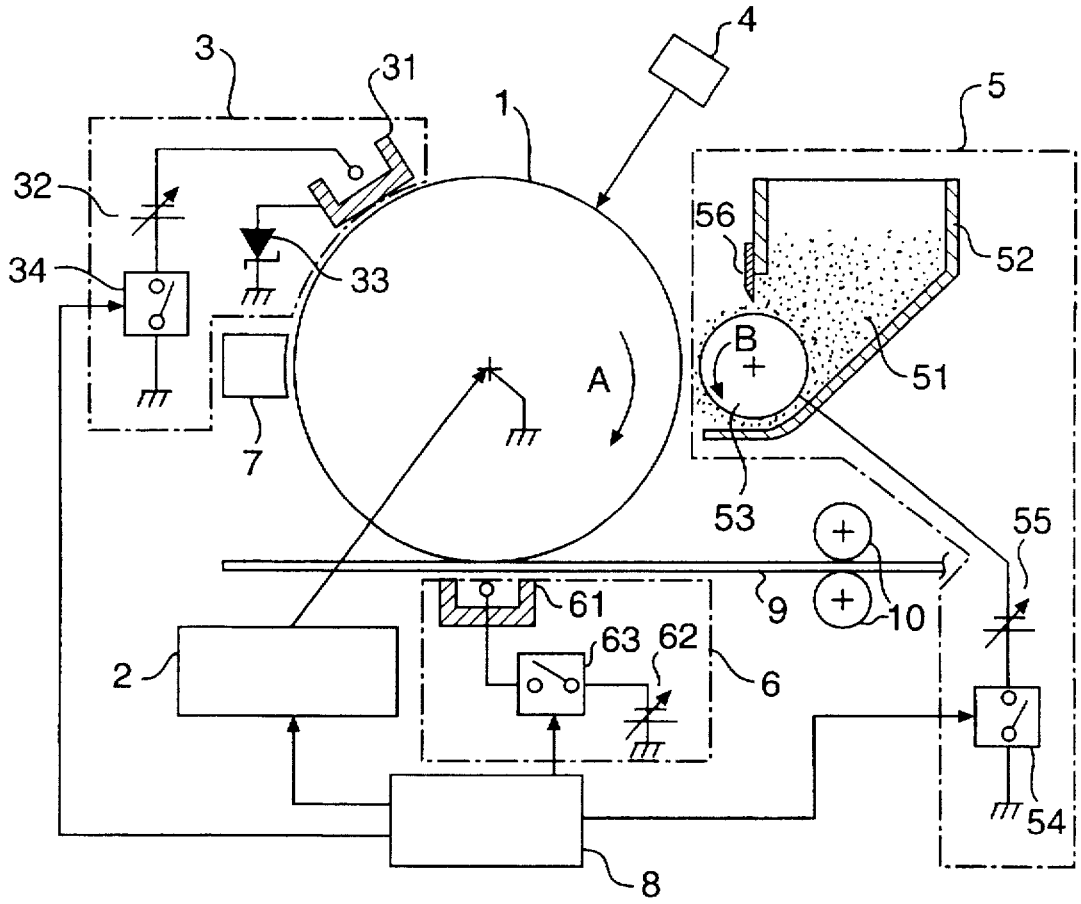
FIG. 2 is an enlarged view of a part of an electrophotographic recording apparatus of the invention.

FIG. 2 shows a photosensitive body and other elements associated therewith in the embodiment of this invention. This figure is a part of FIG. 1 enlarged for detail. Photosensitive drum 1 receives a rotating force from driving unit 2. The driving unit 2 includes a motor, gears, etc. (not illustrated). The driving unit 2 gives rotating force in direction of arrow A to the photosensitive drum 1. The driving unit is controlled by control unit 8.

Disposed outside the photosensitive drum 1 is a charging section 3, an exposure section 4, a developing section 5, transferring section 6 and cleaning section 7. The charging section 3 includes charger 31, high tension power supply 32, zener diode 33 and switch 34. The developing section 5 includes toner box 52, toner 51, sleeve 53, high tension power supply 55, switch 54, and blade 56. Sleeve 53 is given rotating force in the direction of arrow B by a motor (not illustrated). The motor is controlled by the control unit 8. The high tension power supply 55 supplies high tension power to the sleeve 53 for supplying bias electric current. Supply of the bias electric current is controlled by the switch 54.

The switch 54 is controlled by the control unit 8. The sleeve 53 carries the toner 51 out of the toner box 52. The blade 56 regulates the toner 51 on the surface of the sleeve 53. The transferring section 6 includes a transfer charger 61, a high tension power supply 62 and switch 63.

The cleaning section 7 removes toner on the surface of the photosensitive drum 1. The following describes the operation of the electrophotographic recording apparatus.

Figure 3:
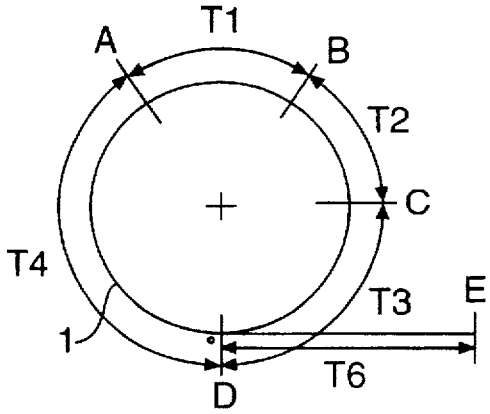
FIG. 3 is a cross-sectional view of a photosensitive drum in one embodiment of this invention.

In FIG. 3, a charging position of the photosensitive drum 1 by the charging section 3, an exposure position of the photosensitive drum 1 by the exposure section 4, a developing position of the photosensitive drum 1 by the developing section 5, and a transferring position of the photosensitive drum 1 by the transferring section 6 are represented by point A, point B, point c and point D, respectively. As for the rotating time of a point of the photosensitive drum 1, time of rotation from the point A to the point B is T1, time of rotation from the point B to the point C is T2, time of rotation from the point C to the point D is T3 and time of rotation from the point D to the point A is T4. The time of one complete rotation of the photosensitive drum 1, namely T1+T2+T3+T4 is T5. The position of roller 10 is represented by point E. The time of conveying the sheet 9 from the point E to the point D is T6.

Figure 4:
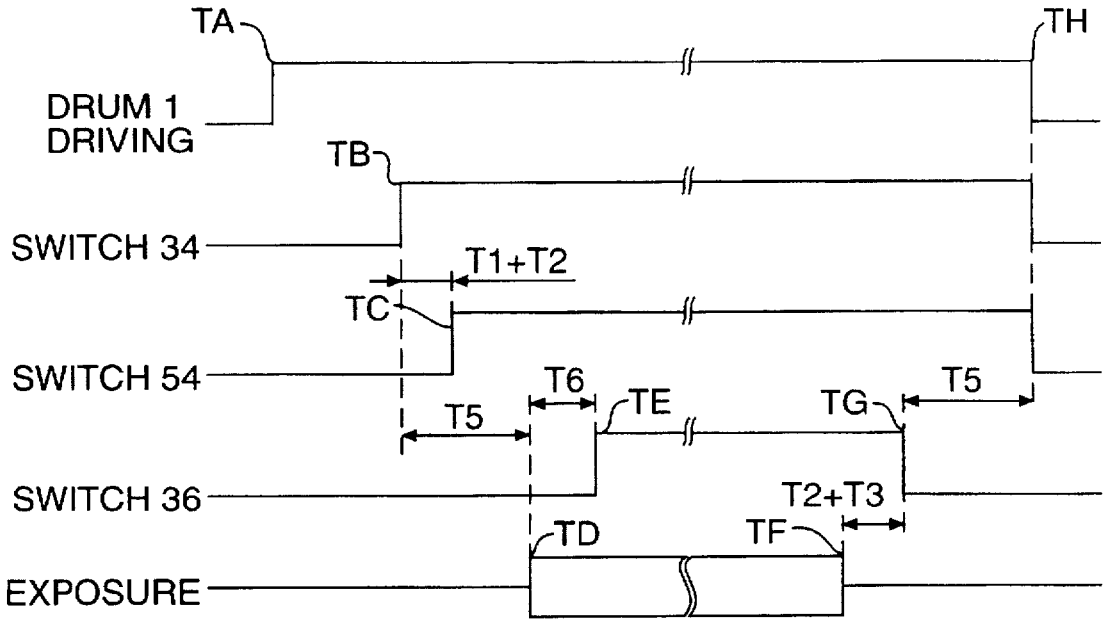
FIG. 4 is a timing chart of the electrophotographic recording apparatus in one embodiment of this invention.

When an operator commands the start of the recording action to this electrophotographic recording apparatus, the control unit 8 sends a start signal to the driving unit 2. The driving unit 2 supplies rotating force to the photosensitive drum 1 (FIG. 4, TA). After a short time from the start of rotation of the photosensitive drum 1, the control unit 8 commands the switch 34 to switch ON, whereupon the corona charger 31 is supplied with high tension power by the high tension power supply 32 (FIG. 4, TB).

Then corona charger 31 charges the photosensitive drum 1 uniformly to a set electric potential. In this time, the photosensitive drum 1 charges to −700[V]. Next, the control unit 8 commands the switch 54 to switch ON T1+T2 after TB. Whereupon the sleeve 53 is supplied with high tension power by the high tension power supply 55 (FIG. 4, TC).

The sleeve 53 develops bias, and is in a condition for possible developing. This developing bias is the same electric polarity as the charging electric polarity of the photosensitive drum 1, and the electric potential of the developing bias is lower than the electric potential of the photosensitive drum 1. Thus, the electric potential of the developing bias, may be, for example, −550|V|. After T5 from TB (FIG. 4, TD), namely after one complete rotation of the photosensitive drum 1 from the start of charging of the photosensitive drum 1, the control unit 8 commands the start of exposure to the exposure section 4.

In this embodiment, "exposure" corresponds to "black image", "non-exposure" corresponds to "white image". Therefore, the portions of the photosensitive drum corresponding to "black image" are reduced in voltage to −100 |V|.

Thus, on the surface of the photosensitive drum, the electric potential of exposed places and non-exposed places are −100|V| and −680|V|, respectively. The electric potential of the developing bias of the sleeve 53 is −550|V|. The toner 51 adheres onto exposed places and does not adhere onto non-exposed places of the surface of the photosensitive drum 1. Because the electric potential of the exposed places is lower than the electric potential of the sleeve 53, the electric potential of the non-exposed places is higher than the electric potential of the sleeve 53. After T6 from the start-of exposing the photosensitive drum 1 (TD), the control unit 8 commands the switch 63 to switch ON. Whereupon the transfer charger 61 is supplied with high tension power by the high tension power supply 62 (FIG. 4, TE). Then, the toner 51 applied onto the surface of the photosensitive drum 1 transfers to the sheet 9 and the image is recorded. Toner remaining on the surface of the photosensitive drum 1 is removed by the cleaning section 7. Next, the photosensitive drum 1 is charged by the charging section 3 again.

Now, on the surface of the photosensitive drum 1, the places where the electric potential is −680|V| and the places where the electric potential is −100[V] changes to places where the electric potential is −750[V] and −700[V], respectively, as a result of the charging. After [T2+T3] from finishing the exposing of the photosensitive drum 1 (FIG. 4, TF), the control unit 8 commands the switch 63 to switch OFF. Whereupon the transfer charger 61 is stopped (the transferring finishes) (FIG. 4, TG).

Therefore, the action of recording is finished. On the other hand, the rotation of the photosensitive drum 1, and the action of the charging section 3 and the developing section 5 is not stopped. After T5 from TG, namely after one rotation of the photosensitive drum 1 from TG, the rotation of the photosensitive drum 1, and the action of the charging section 3 and the developing section 5 is stopped (FIG. 4, TH).

Accordingly, all of the surface of the photosensitive drum 1 charges on a non-exposure condition. Because all the surface of the photosensitive drum 1 is at a high tension potential condition, the toner 51 is not applied onto the surface of the photosensitive drum 1.

As can be seen from the above, it is possible for a device, according to the invention, to operate without the erasing step required in the finish art. Any differences which may exist in the charge pattern on the drum, equal to −700 to −750 volts, do not interfere with the exposure and developing of subsequent images. Thus, the problems and disadvantages which resulted from the prior art erasing step have been solved by this invention.

We claim:

1. An electrophotographic recording apparatus comprising:

photosensitive means including a rotatable drum and a driving motor to rotate the drum, the drum having a surface to which toner is attracted by a voltage charge on the surface that is positive in relation to a bias voltage charge on the toner;

charge means for uniformly charging the surface of the photosensitive means to a first predetermined voltage;

exposure means for exposing the surface of the photosensitive means to form an electrostatic latent image in at least two image charges on the surface of the photosensitive means, said image charges having relatively high and low voltages corresponding to white and black image areas, respectively, the high voltage of the image charges being lower than said first predetermined voltage;

developing means for applying toner onto the surface of the photosensitive means to develop the electrostatic latent image, said developing means including means for applying a bias voltage to the toner, said bias voltage being of a value intermediate the high and low voltages of said image charges;

transfer means for transferring the developed image to a transfer sheet;

means, including said charge means, for precharging the photosensitive means to at least said bias voltage for re-exposure after the developed image is transferred to a transfer sheet; and a control unit operative to turn on the driving motor to rotate the drum three revolutions for each recording operation, the control unit (a) turning on the bias voltage a fixed time period following turning on of the charging means to rotate the drum so that the complete surface of the drum is rotated past the developing means during a first revolution, (b) turning on and off the exposure means and the transfer means during the second revolution, the turning off of the transfer means occurring at the beginning of a third revolution, and (c) turning off the driving motor, the charging means, and the bias voltage upon completion of the third revolution so that the entire surface of the drum is rotated past the developing means during the third revolution in a non-exposure condition.

* * * * *